US007107924B2

(12) United States Patent
Schroeder

(10) Patent No.: US 7,107,924 B2
(45) Date of Patent: Sep. 19, 2006

(54) BOAT HULL PATCH ANCHOR AND METHOD FOR ITS USE

(76) Inventor: Michael Schroeder, 1432 Seventh Ave., Santa Cruz, CA (US) 95062

( * ) Notice: Subject to any disclaimer, the term of this patent is extended or adjusted under 35 U.S.C. 154(b) by 0 days.

(21) Appl. No.: 11/001,937

(22) Filed: Dec. 2, 2004

(65) Prior Publication Data

US 2006/0118028 A1 Jun. 8, 2006

(51) Int. Cl.
*B63B 43/16* (2006.01)

(52) U.S. Cl. ..... 114/229; 156/94; 428/63

(58) Field of Classification Search ..... 114/227, 114/228, 229, 355; 428/63, 77, 78; 156/94
See application file for complete search history.

(56) References Cited

U.S. PATENT DOCUMENTS 4,707,391 A 11/1987 Hoffmann
4,776,906 A * 10/1988 Bernard ..... 428/63
5,298,099 A 3/1994 Hoffmann
5,620,768 A 4/1997 Hoffmann
6,231,949 B1 * 5/2001 Hoffmann, Sr. ..... 428/63

* cited by examiner

*Primary Examiner*—Lars A. Olson
(74) *Attorney, Agent, or Firm*—Michael A. Guth

(57) ABSTRACT

A boat hull patch anchor adapted to be placed on the inside surface of a boat hull over and overlapping a hole in the hull. The hole in the boat hull may be tapered prior to bonding. A repair compound is applied from the outside surface of the boat hull. A method for the repair of a boat hull including tapering the profile of a hole in a boat hull, applying the patch anchor from the inside of the hull, and applying repair compound from the outside of the hull so as to fill the hole and anchor the patch.

7 Claims, 7 Drawing Sheets

BOAT HULL PATCH ANCHOR AND METHOD FOR ITS USE

BACKGROUND

1. Field of the Invention

The present invention is generally related to the repair of boat hulls and similar items, and more specifically to a boat hull patch anchor and a method for its use.

2. Description of Related Art

Boat hull repair is often facilitated by the placement of a temporary backing plate inside of the hull covering a hole in the hull. The temporary backing plate acts as a form over which to create a patch. The plate acts to give support to the repair compound so that a hole can be traversed. After the repair, the backing plate is removed. Often the backing plate must be hammered or chiseled off the back of the repaired area due to adhesion to the patching compound. Wood has often been used as such a backing plate. In addition to being unsightly and bulky, wood must be removed to prevent it from becoming mildewed and rotten.

What is called for is a method and means for patching a boat hull without the need for removing a backing plate. What is also called for is a material that can be used as a backing plate for hull repair that can be formed to the various contours of a boat hull.

SUMMARY

A boat hull patch anchor adapted to be placed on the inside surface of a boat hull over and overlapping a hole in the hull. The hole in the boat hull may be tapered prior to bonding to help prevent the patch from being pushed through from the outside. A repair compound is applied from the outside surface of the boat hull and the repair compound is anchored to the hull in part by the bonding of the anchor to the repair compound. A method for the repair of a boat hull including tapering the profile of a hole in a boat hull, applying the patch anchor from the inside of the hull, and applying repair compound from the outside of the hull so as to fill the hole and anchor the patch.

DETAILED DESCRIPTION

Figure 1:
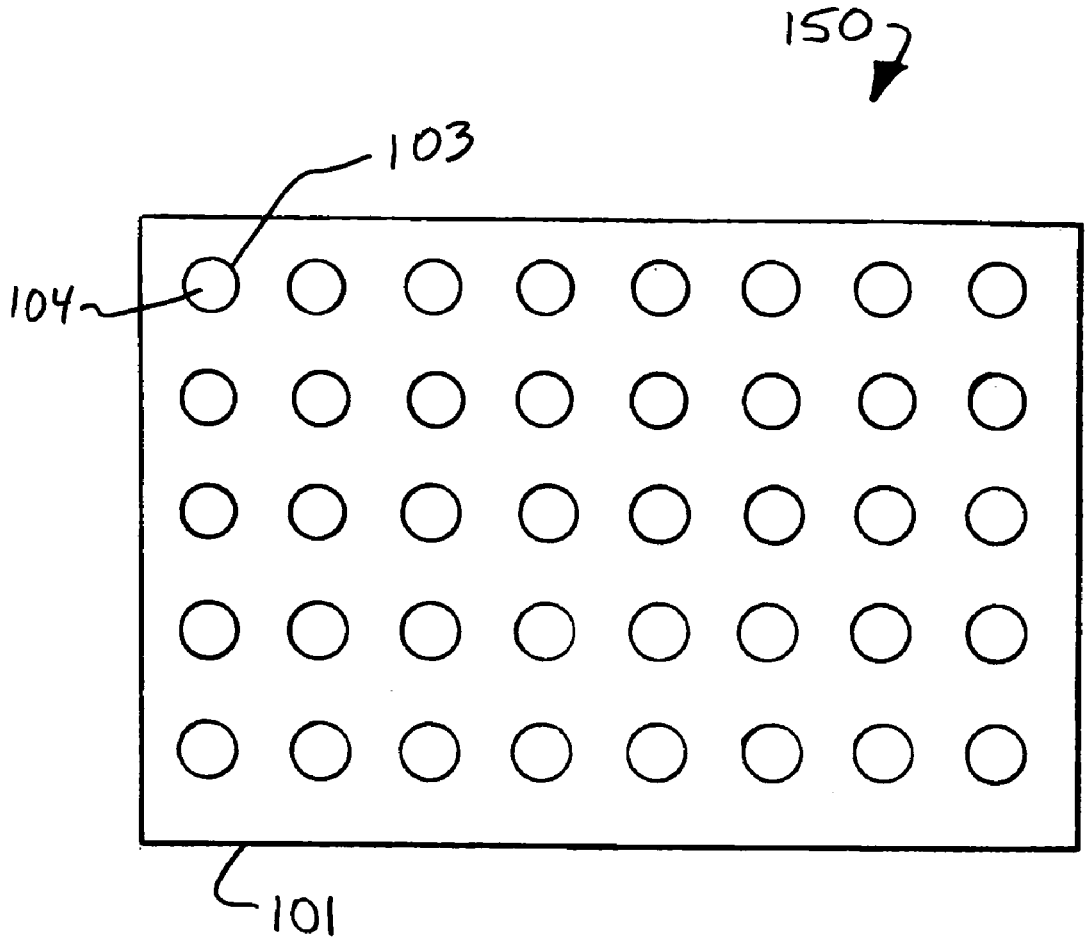
FIG. 1 is a top view of a boat hull patch anchor according to one embodiment of the present invention.

FIG. 1 illustrates a top view of a boat hull patch anchor 150 according to one embodiment of the present invention. A plate 101 has a plurality of through holes 103 that extend from its top side to its bottom side. In some embodiments, the plate 101 is a deformable, relatively thin plate. In some embodiments, the plate is made of a material such as a PVC plastic, kevlar, or aluminum. An example of such a PVC plastic material is Sintra®, by Alcan Composites of St. Louis, Mo. The plate 101 is made of a suitable material that can bend out of plane slightly with relative ease while maintaining rigidity. In some embodiments, the plate 101 is made of a material that can be significantly deformed with the application of heat, such as with a heat gun or a hair dryer. In some embodiments, the plate 101 retains its deformed shape after cooling. In some embodiments, the plate 101 is 1 mm, 2 mm, or 6 mm thick.

The plate 101 has a plurality of through holes 103 that extend from the top side of plate 101 to the bottom side of plate 101. In some embodiments, the plurality of through holes 103 are comprised of circular holes 104. In some embodiments, the circular holes 104 are approximately one quarter of an inch in diameter. In some embodiments, the holes are in the range of $\frac{1}{8}^{th}$ to ½of an inch in diameter. In some embodiments, the through holes are squares, rectangles, or other shapes. Although the boat hull patch anchor 150 is shown with a particular number of holes, this is an illustrative representation.

The boat hull patch anchor 150 may be of a variety of sizes and shapes. The boat hull patch anchor 150 may be manufactured in large sheets or rolls, and later sized for a particular application. In some embodiments, the boat hull patch anchor 150 may be manufactured in bulk sizes of 4 feet by 8 feet with a 3 mm plate 101 thickness. In some embodiments, the boat hull patch anchor 150 may be manufactured in bulk sizes of 4 feet by 1 feet, and 4 feet by 2 feet.

Figure 2:
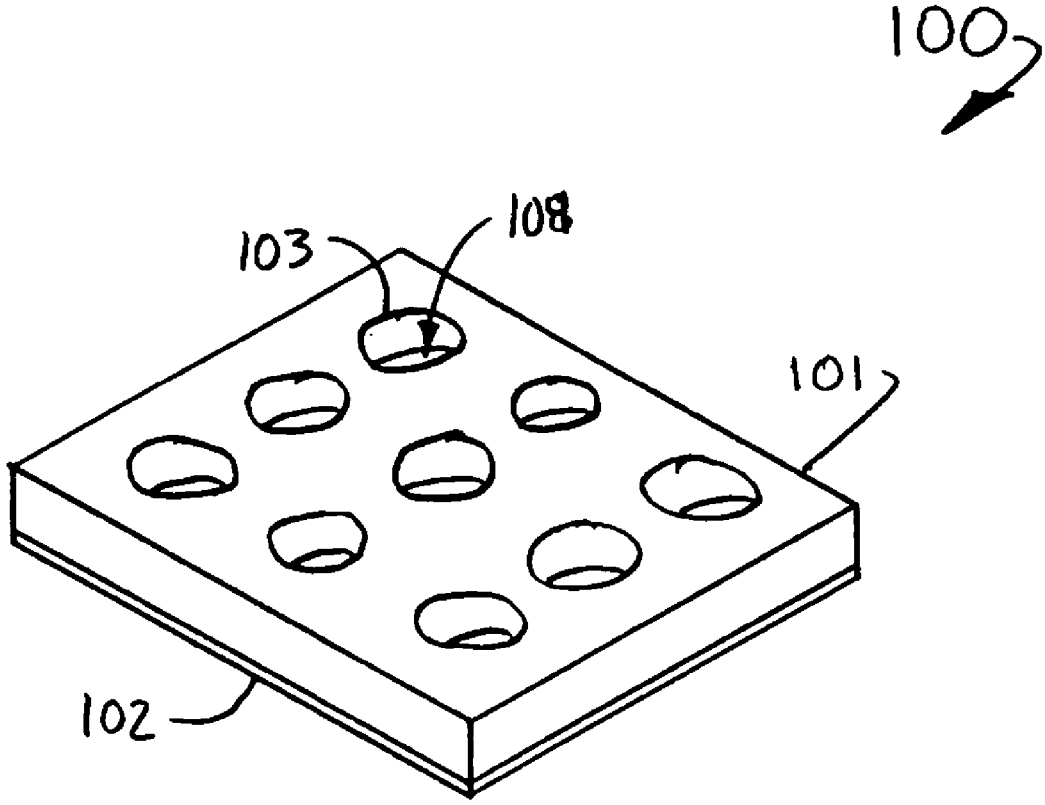
FIG. 2 is a perspective view of a boat hull patch anchor according to one embodiment of the present invention.

FIG. 2 illustrates a perspective view of a boat hull patch anchor 100 according to some embodiments of the present invention. A plate 101 has a plurality of through holes 103 through from its top surface to its bottom surface. A fabric layer 102 is adhered to the bottom surface of the plate 101. In some embodiments, the fabric layer 102 is made of a blend of 30% rayon and 70% nylon. In some embodiments, the fabric layer 102 is made of a Pellon 30 product. In some embodiments, the fabric layer 102 is made of kevlar. In some embodiments, the fabric layer 102 is made from a fabric that does not fray and is easy to cut and work with during the manufacturing of the boat hull patch anchor 100. The fabric layer 102 prevents the patching compound used with the boat hull patch anchor 150 from flowing all the way through the plurality of through holes 103 when repairing a boat hull. The fabric layer 102 allows the patching compound used with the boat hull patch anchor to be absorbed, enhancing the bond strength of the boat hull patch anchor 150 to the patch.

In some embodiments, a curable adhesive is used to adhere the fabric layer 102 to the plate 101. In some embodiments, the adhesive is an adhesive such as 3M Hi-Strength 90 multi-purpose adhesive, by the 3M Corporation of St. Paul, Minn. The fabric layer covers substantially all of the bottom surface of the plate 101, as well as covering across the bottoms of the holes 103. The fabric layer 102 provides a somewhat porous fabric bottom 108 to the holes 103.

Figure 3:
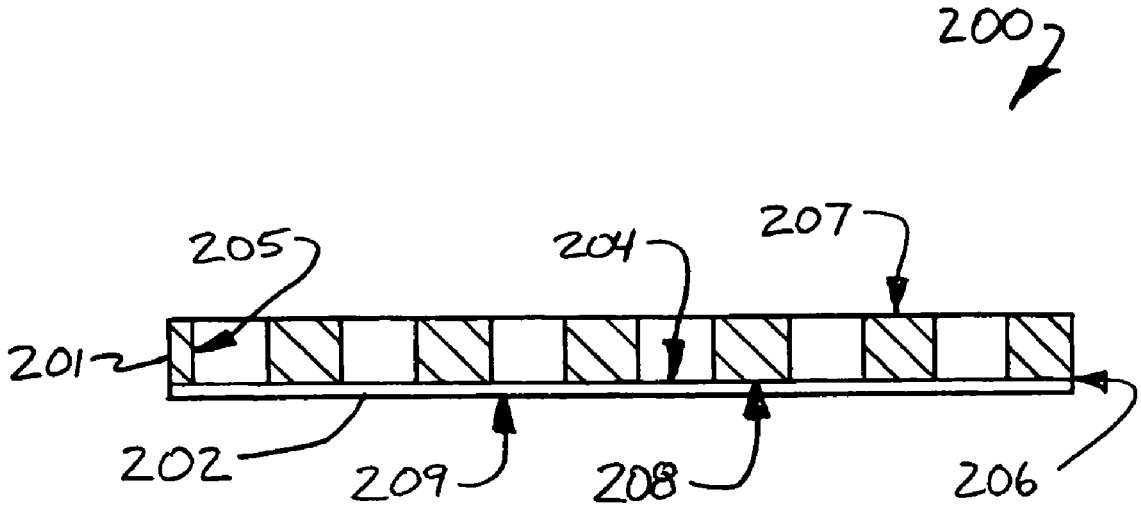
FIG. 3 is a cutaway view of a boat hull patch anchor according to one embodiment of the present invention.

FIG. 3 illustrates a cross-sectional side view of a boat hull patch anchor 200 according to some embodiments of the present invention. A plate 201 has a first surface 208 and a second surface 207. The plate is made of PVC plastic in some embodiments. A fabric layer 202 is adhered to the first surface 208 of the plate 201. In some embodiments, a thin layer of adhesive 206 adheres the fabric layer 202 to the plate 201. The fabric layer creates a barrier 204 at the bottom of holes 205 in the plate 201. In some embodiments, the holes are regularly spaced circular holes. In some embodiments, the holes are 0.25 inches in diameter on a regular 0.5 inch spacing. The back surface 209 of the fabric layer 202 creates the back of the boat hull patch anchor in some embodiments.

Figure 4:
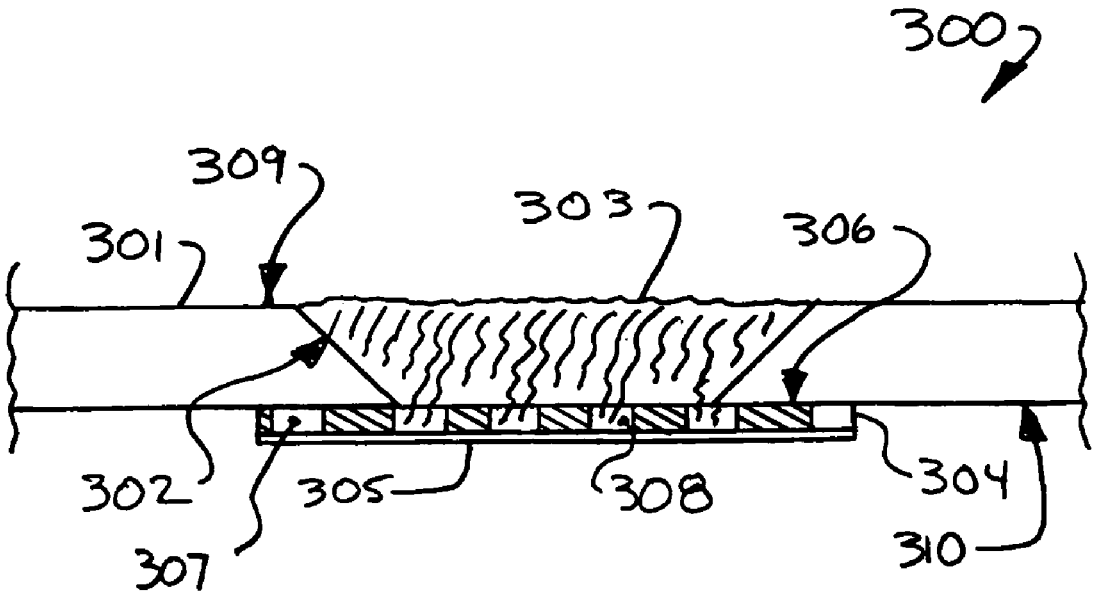
FIG. 4 is a cutaway view of a boat hull patch system according to one embodiment of the present invention.

FIG. 4 is a cross-sectional side view of a boat hull patch system 300 utilizing a boat hull patch anchor 304 according to some embodiments of the present invention. The boat hull 301 has an outer surface 309 and an inner surface 310. The outer surface 309 of the boat hull 301 is the surface which resides at least partially in the water while the boat is in use. The boat hull 301 is typically made of fiberglass, graphite epoxy, or other materials.

The hole 302 has its edges tapered in some embodiments. In some embodiments, the hole 302 has its edges tapered at a 45 degree angle. The boat hull patch anchor 304 provides a backing plate and anchor for the patching compound 303. The boat hull patch anchor 304 is joined to the inner surface 310 of the boat hull 301 with an adhesive 306 in some embodiments. The patch 303 is formed of a patching compound which has flowed through holes 308 in the boat hull patch anchor 304. Some holes 307, which are not open to the hole 302, do not have patching compound in them in some embodiments. The patching compound has permeated the fabric layer 305 enhancing the adherence of the boat hull patch anchor 304 to the patch 303.

Figure 5A:
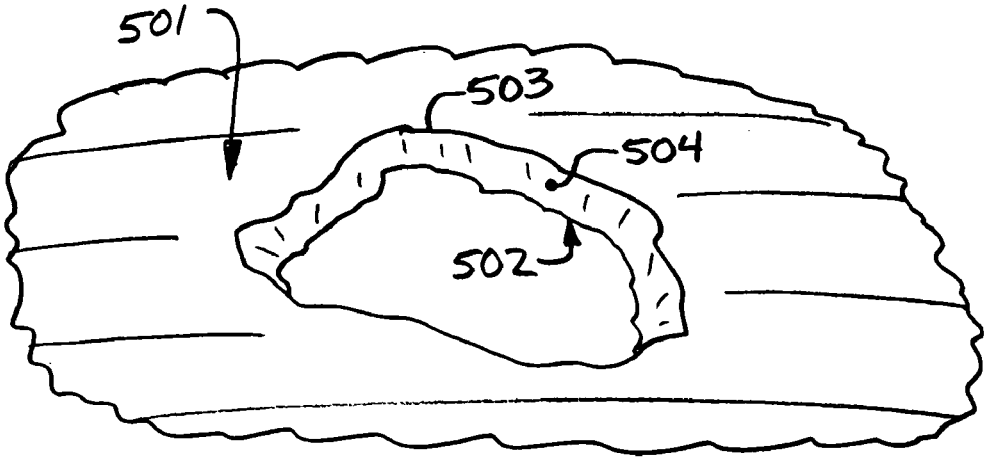
FIGS. 5A–E are illustrations of a boat hull hole and its repair according to some embodiments of the present invention.
Figure 5B:
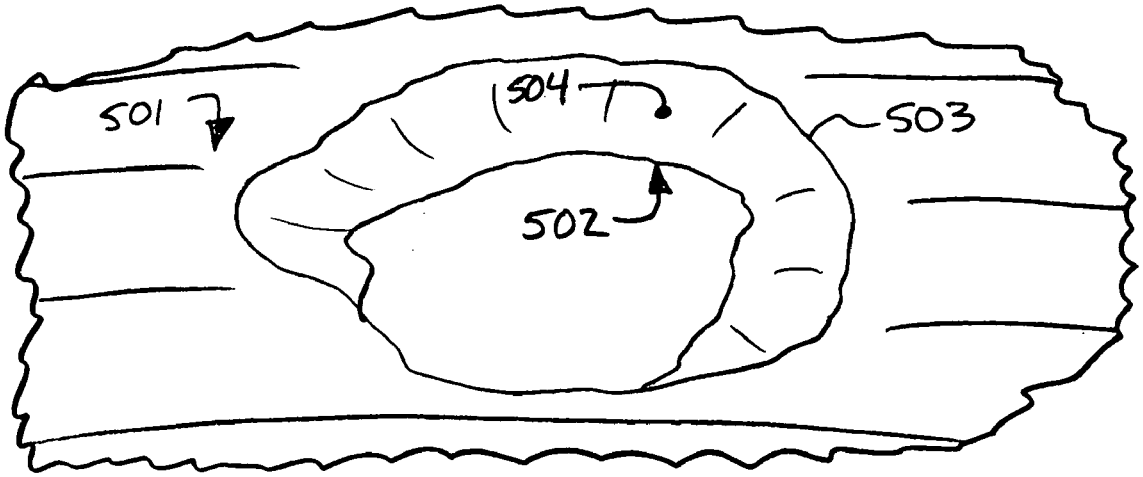

FIGS. 5A–E illustrate the method steps of repairing a boat hull according to some embodiments of the present invention. As shown in FIG. 5A, the outside surface 501 of boat hull is seen. A hole 503 with a hole contour 504 extends from the outer surface 501 of the boat hull through to the inner surface 502 of the boat hull. In some embodiments of the present invention, as seen in FIG. 5B, the hole contour 504 has been altered to facilitate repair. The hole contour 504 is tapered outwards from the inner surface 502 of the hull to the outer surface 501 of the hull. The diameter of the hole 503 is increased due to the tapering. The hole 503 may be tapered to a variety of angles, including in the range of 30–60 degrees. The tapering may be done using a file, a saw, or with other means. In some embodiments, the tapering is done with a portable grinder with a 40 or 60 grit disc.

Figure 5C:
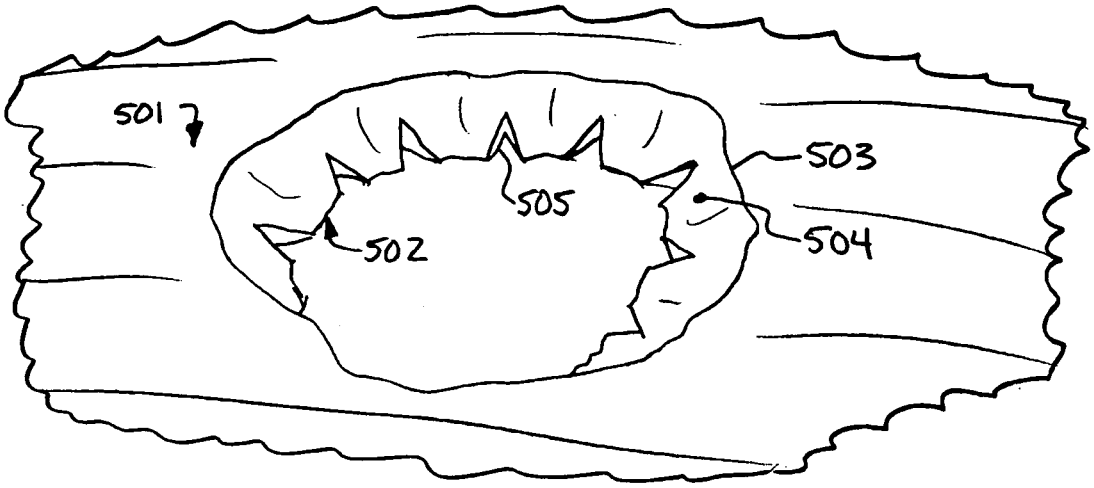

In some embodiments of the present invention, as seen in FIG. 5C, serrations 505 are cut into the hole contour 504. The serrations 505 may be cut into the hull using a file, router, saw, jigsaw, or with other means. In some embodiments, the serrations SOS are placed every $\frac{3}{8}^{th}$ of an inch around the hole contour 504.

Figure 5D:
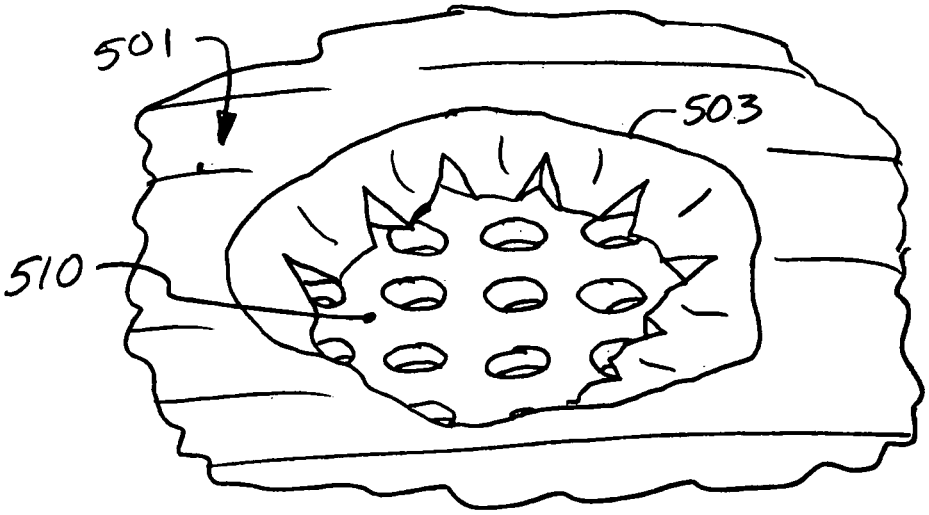

As seen in FIG. 5D, a boat hull patch anchor 510 is placed on the inside surface of the hole. The boat hull patch anchor 510 is placed with the fabric layer away from the hull. The boat hull patch anchor 510 may be trimmed to the approximate shape, with overlap, of the hole. In some embodiments, the boat hull patch anchor may be molded to the shape of the interior of the hull, or other suitable shape, using a heat source. In some embodiments, the boat hull patch anchor is easily molded to an appropriate shape, typically to follow the contours of the inside of the boat hull, using a heat gun. In some embodiments, the boat hull patch anchor retains its new molded shape after cooling. In some embodiments, the overlap will be 1–4 inches of overlap along the interior of the hull. In some embodiments, the boat hull patch anchor is fastened to the inside of the boat hull using adhesives. In some embodiments, the boat hull patch anchor is fastened to the inside of the boat hull using a 2 part epoxy or an epoxy resin sealer paste. In some embodiments, the boat hull patch anchor is fastened to the inside of the boat hull using the same casting resin that may later be used in the patching process. The resin adhering the boat hull patch anchor to the interior of the hull may be allowed to set, or to cure, prior to proceeding. In some cases, there may not be access from the inside of the hull to place the boat hull patch anchor into position. In such cases, the boat hull patch anchor may be inserted through the hull from the outside to gain its position inside the hull. In such cases, the boat hull patch anchor may be held in place during bonding to the inside surface of the hull. In some cases, this may be done using a loop of wire or other suitable material that may be punched through the fabric layer at the bottom of one of the holes in the plate, and then looped back by punching through another hole, for example, so that the boat hull patch anchor can be pulled from the outside in order to apply pressure during bonding. The loop of wire may then be remove after the boat hull patch anchor has bonded to the inside of the boat hull.

Figure 5E:
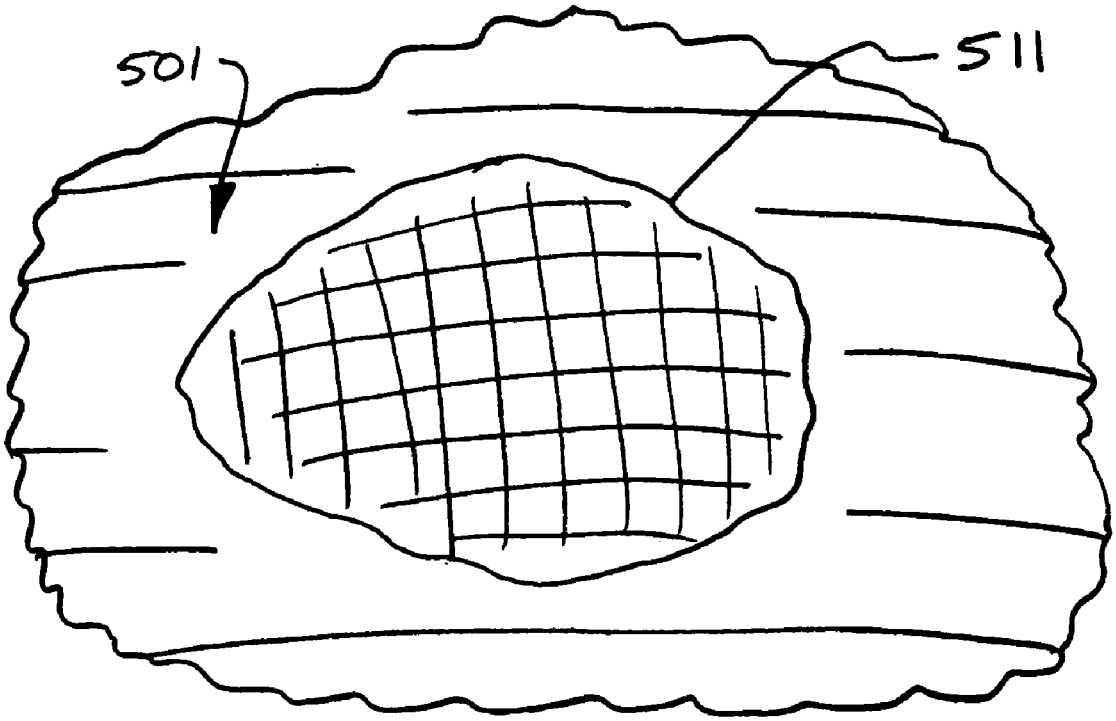

As seen in FIG. 5E, the hole in the boat hull is filled with a patch 511. The patch 511 is placed into the hole and held from going through the hole by the boat hull patch anchor. In some embodiments of the present invention, the patch 511 is a composite of fiberglass and resin. In some embodiments, the fiberglass consists of chopped fibers. In some embodiments, the fiberglass consists of fiberglass cloth. In some embodiments, a single compound, such as resin or other material, is used.. In some embodiments, a polyester marine fiberglass resin is used, such as Evercoat® Premium Marine Resin. In some embodiments, the patch 511 fills the holes in the surface of the boat hull patch anchor plate. In some embodiments, the resin soaks into the fabric layer on the back side of the boat hull patch anchor.

After curing, the patch 511 has repaired the hole in the hull. The boat hull patch anchor becomes an integral part of the patched hull. There is no need for subsequent removal of the boat hull patch anchor. In addition, the patch anchor is not vulnerable to rotting or degradation due to environmental conditions.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

I claim:

1. A boat hull patch anchor comprising:

a deformable relatively thin plate, said thin plate comprising a first side and a second side, said thin plate comprising a plurality of through holes through from aid first side to said second side;

a fabric layer, said fabric layer adhered to said first side of said thin plate, said fabric layer covering substantially all of said first layer of said thin plate;

an adhesive layer, said adhesive layer interspersed between said thin plate and said fabric layer, said adhesive layer adapted to adhere said fabric layer to said thin plate; and wherein said deformable relatively thin plate is adapted to deform easily with the application of heat, and wherein said deformable relatively thin plate retains its deformed shape after cooling.

2. The boat hull patch anchor of claim wherein said thin plate has a thickness in the range of 0.125 inches to 0.375 inches.

3. The boat hull patch anchor of claim 1 wherein said fabric layer comprises rayon and nylon.

4. The boat hull patch anchor of claim 3 wherein said through holes are circular holes of 0.25 inches in diameter.

5. The boat hull patch anchor of claim 1 wherein said thin plate comprises PVC plastic.

6. A method for patching a boat hull, said method comprising:

trimming a boat hull patch anchor to the size of a damaged portion of a hull with an overlap;

adhering the trimmed boat hull patch anchor to the inside surface of the hull surrounding the damaged hull area;

filling the damaged area with a patching compound; and wherein said trimming a boat hull patch anchor to the size of a damaged portion of a hull comprises shaping the boat hull patch anchor using heat.

7. A method for patching a boat hull, said method comprising:

trimming a boat hull patch anchor to the size of a damaged portion of a hull with an overlap;

adhering the trimmed boat hull patch anchor to the inside surface of the hull surrounding the damaged hull area;

filling the damaged area with a patching compound; and inserting the boat hull patch anchor through the hole in the hull from the outside of the hull, wherein the damaged portion of a hull comprises a hole through the hull.

* * * * *